United States Patent [19]

Walter

[11] 4,407,423

[45] Oct. 4, 1983

[54] DETACHABLE RESEALABLE CLOSURE

[75] Inventor: John Walter, Evergreen Park, Ill.

[73] Assignee: The Continental Group, Inc., Stamford, Conn.

[21] Appl. No.: 358,164

[22] Filed: Mar. 15, 1982

[51] Int. Cl.[3] ..... B65D 51/16; B65D 39/00

[52] U.S. Cl. ..... 220/260; 220/307; 220/270

[58] Field of Search ..... 220/260, 257, 270, 271, 220/307; 222/543

[56] References Cited

U.S. PATENT DOCUMENTS

| | | | |
|---|---|---|---|
| 3,347,408 | 10/1967 | Baker, Sr. | 220/307 |
| 4,327,842 | 5/1982 | Walter | 220/367 |
| 4,328,906 | 5/1982 | Walter | 220/260 |
| 4,344,545 | 8/1982 | Walter | 220/307 |
| 4,362,254 | 12/1982 | Roth et al. | 220/307 |

*Primary Examiner*—George T. Hall

*Attorney, Agent, or Firm*—John J. Kowalik

[57] ABSTRACT

A plastic closure and metal neck structure of a container, having resealable interlocking portions and wherein the closure has a pull tab which not only provides a sanitary cover for the pouring lip of the neck but also functions to pull the plug of the closure out of the pouring bore of the neck.

10 Claims, 4 Drawing Figures

DETACHABLE RESEALABLE CLOSURE

BACKGROUND OF THE INVENTION

This invention relates to closures particularly for narrow-neck containers. A number of this type of closures are presently on the market. The most successful of these closures require the closure to be torn apart to open and thus make no provision for reclosure (see German Pat. No. 2556741). Most of such closures also provide for a portion of it to remain with the container and a number of others are so formed that the closure itself provides a plastic pouring neck and a plastic plug is tightly fitted within the plastic neck. If the plastic is too cold when the container is opened the sealing areas are frequently chipped or deformed so that upon resealing, the closure leaks (see U.S. Pat. No. 3,160,327).

SUMMARY OF THE INVENTION

The principal object of the invention is to provide a novel plastic removable closure which interlocks with a metal neck structure of a container and thus obviates the problems of sealing plastic to plastic, the metal in the sealing areas being so contoured that it will not fracture or destroy the plastic seal with which it cooperates during opening and closing of the container.

A further object is to provide a novel closure and neck structure wherein the neck structure is formed to provide a fulcrum for an opening lever which is attached to the plug of the closure so that if it is intended to open the closure, the lever may be simply lifted and swung over the fulcrum while pulling the plug to which it is fastened out of the neck of the container.

Another aspect of the invention resides in providing a sanitary plastic closure fitted into the non-plastic neck of the container which is fashioned to interlock with a plug portion of the closure below the level of the top edge of the neck, the closure comprising a top portion in the form of a disk which lays over the top edge of the neck and thus prevents dirt from accumulating between the neck and the closure.

These and other objects and advantages inherent in and encompassed by the invention will become more apparent from the specification and the drawings, wherein.

DESCRIPTION OF THE INVENTION

Figure 1:
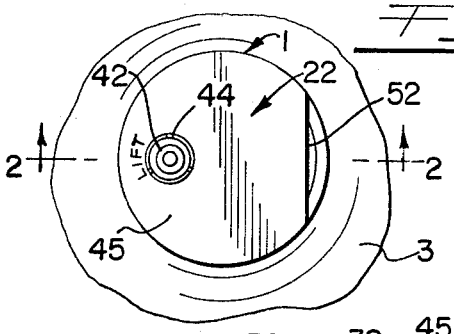
FIG. 1 is a fragmentary top plan view of a container having the novel closure assembly applied thereto.

The novel closure and neck assembly generally designated 1 comprises a neck 2 at the upper end of a dome shaped upper end portion 3 of a metal (preferably aluminum) can or container. The can has a cylindrical body and an integral bottom (not shown) as well known in the art.

A feature of the invention is the novel neck structure 2 which comprises a frusto-conical external tubular portion 7 integrally formed with the dome 3. Portion 7 terminates at its narrower upper end and merges into an outer edge of a flat ring-like flange or lip 10 of the neck.

The inner edge of the lip 10 merges into the upper edge of a downwardly tapering intermediate frusto-conical wall 12 which terminates at its lower end in an inturned flange or ledge 14 located intermediate the top and bottom of the neck structure 2. The inner edge of flange 14 is turned upwardly into a short wall 16 to provide a sharp corner 18. The upper end of the wall 16 is rolled into an outturned buttressing curl 19 spanning the space between the wall 16 and wall 12 and in abutment with wall 12 to provide radial reinforcement for the top edge of the thin frusto-conical wall 16.

The wall 16 defines a bore surface 20 which admits a plug of a plastic closure 22 therein, said closure 22 comprising a cylindrical sleeve or shank 24 with an outwardly directed sealing ring 25 along its lower edge. The ring 25 is downwardly tapered at 26 to facilitate its entry into bore 20, and has a top sealing surface 28 which snaps under the surface 29 of the flange or ledge 14 of the neck. The shank 24 has adjacent to its upper edge an external sealing ring 30 of triangular cross-section having an apical edge deformed against the bore surface 20. The closure has a top wall 32 integral with the upper edge of the plug shank and the wall 32 has a marginal peripheral portion 34 tangentially sealed as at 35 against the top edge of the curl 19. The center portion of wall 32 is disked downwardly to increase the resistance of the wall 32 to outward deflection due to pressure of gasses in the container which is intended for pressurized beverages.

Figure 2:
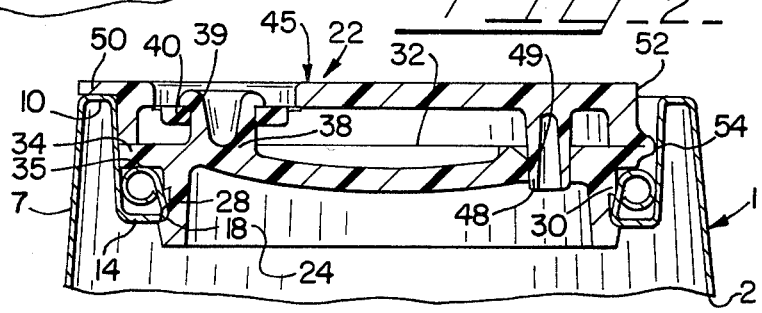
FIG. 2 is an enlarged cross-sectional view on line 2—2 of FIG. 1.
Figure 3:
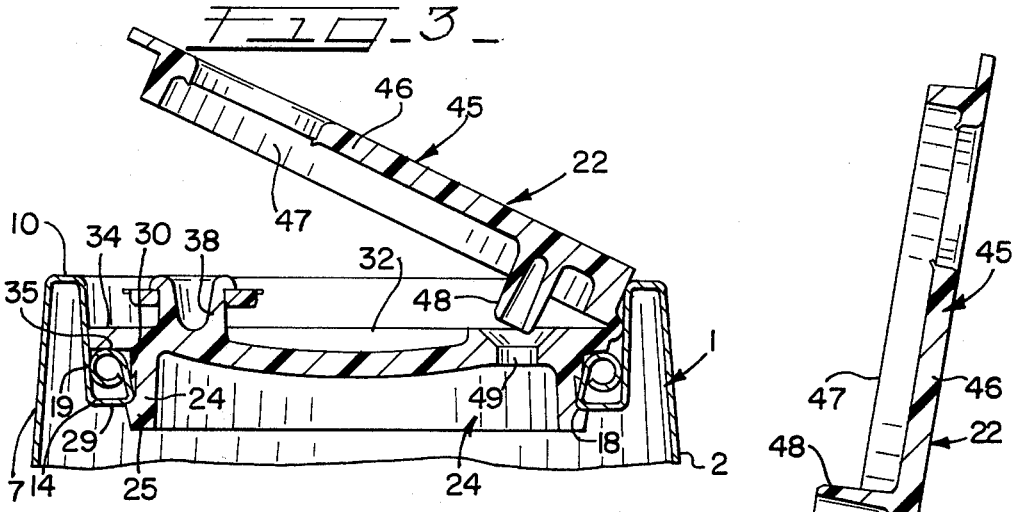
FIG. 3 is a view similar to FIG. 2 showing the parts with the opening lever lifted and the container vented.
Figure 4:
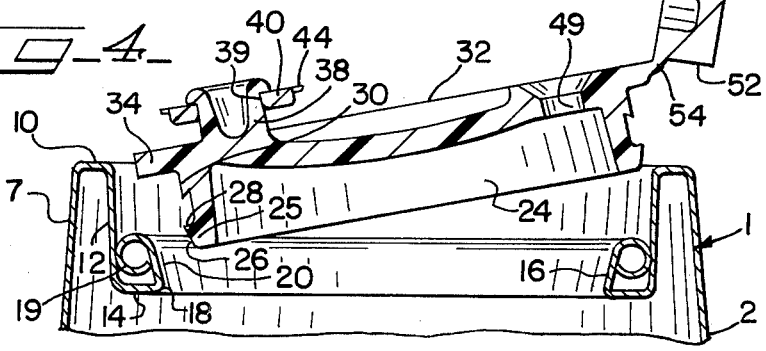
FIG. 4 is a further view similar to FIGS. 2 and 3 showing the open position with the closure lifted out of the container neck.

Wall 32 has an upstanding rivet 38 formed thereon which extends through an aperture 39 of a disk 40 of a pilfer-indicating device, generally designated 42. This disk is attached by frangible straps 44 to the lifting lever on tab 45 which in closed position of the closure overlies the top wall 32 as seen in FIG. 2. The lever 45 comprises an annular wall 46 with a dependent flange 47 spaced slightly inwardly from its periphery for strengthening purposes. The lever is provided with a vent pin 48 which is entered into a vent opening 49 in wall 32 as best seen in FIG. 2. The lever has its peripheral edge portion 50 outwardly of the flange 47 seated in closed position on top of lip 10. The lever has a chordal edge portion 52 opposing an adjacent portion of the lip which also serves as a fulcrum for the layer. The lever is tethered by a strap 54 to a peripheral edge of the top wall 32 of the plug so that when the lever is lifted from its position in FIG. 2 to FIG. 3 breaking the pilfer-indication, it will fulcrum about the lip and pull on the tether and lift the plug or stopper out of the bore. After the plug is removed, flow of fluid is unobstructed. To reseal, the plug is forced into the bore to the position shown in FIG. 2 and the lever is laid over the plug to enter the vent pin 48 into the vent opening 49.

Thus it will be apparent that the sealing occurs between plastic and metal parts. The plastic may be made from polyethylene or polypropylene or any other like suitable resin such as will have the requisite flexbility to enter into the bore and to properly seal as the plug is loaded axially and radially.

What is claimed is:

1. A pressure-resistant assembly comprising a combination of a thin metal neck structure having a plurality of radially spaced wall portions and one of which provides a closure-receiving bore and another wall portion of which provides a support for said one portion, said one portion having radial expansion inhibiting means spanning the space between said portions, and a plastic closure comprising a radially expandable hollow plug having a seal tight fit within said one wall portion and positioned in radial alignment with said inhibiting means.

2. The invention according to claim 1 and wherein said portions are interconnected to provide a shoulder therebetween, and said closure having a sealing ring interposed with respect to said shoulder in the closed position of said closure.

3. The invention according to claim 2 and said expansion inhibiting means comprising a curl integral with said one portion.

4. A hollow neck structure made of thin metal comprising outer, intermediate and inner interconnected generally concentric tubular portions, and means between said inner and intermediate portions being disposed in a radially buttressing relationship thereto, and a closure sealing ledge extending between said inner and intermediate portions.

5. The neck structure according to claim 4 and said means comprising an outturned curl on the upper edge of said inner portion.

6. The invention according to claim 5 and a narrow lip interconnecting said intermediate and outer portions.

7. The invention according to claim 5 in combination with a closure wherein said closure is made of flexible plastic material and releasably embraces the top and bottom ends of said inner portion.

8. The invention according to claim 7 and wherein said neck has an upper end and the closure has a top portion overlapping said upper end to provide a sanitary seal against said upper end.

9. The invention according to claim 8 wherein said top portion is formed and arranged to provide a pullout tab for said closure.

10. The invention according to claim 9 and wherein said closure is expandable radially in sealing relation to said inner portion and is formed and arranged to be loaded axially by pressurized gasses introduced into the container to tightly engage said closure with said ledge in sealing relation therewith.

* * * * *